United States Patent [19]

Kwasnik, Jr.

[11] 4,398,504

[45] Aug. 16, 1983

[54] STEAM GENERATING HEAT EXCHANGER

[75] Inventor: Andrew F. Kwasnik, Jr., Ellington, Conn.

[73] Assignee: Combustion Engineering, Inc., Windsor, Conn.

[21] Appl. No.: 312,037

[22] Filed: Oct. 16, 1981

Related U.S. Application Data

[63] Continuation of Ser. No. 114,472, Jan. 23, 1980, abandoned.

[51] Int. Cl.[3] ..... F22G 3/00

[52] U.S. Cl. ..... 122/468; 122/467

[58] Field of Search ..... 122/467, 182 R, 121, 122/122, 468, 481

[56] References Cited

U.S. PATENT DOCUMENTS

| | | | |
|---|---|---|---|
| 2,869,521 | 1/1959 | Hardgrove | 122/481 |
| 2,894,494 | 7/1959 | Brooks et al. | 122/510 |
| 2,948,267 | 8/1960 | Koch et al. | 122/481 |
| 3,263,423 | 8/1966 | Gorzegno et al. | 122/468 X |
| 3,312,198 | 4/1967 | Eckerlin | 122/481 X |

*Primary Examiner*—Edward G. Favors
*Attorney, Agent, or Firm*—William W. Habelt

[57] ABSTRACT

A steam generating heat exchanger (2) for cooling a high pressure, hot gas laden with molten ash particles comprising an inverted U-shaped pressure containment structure (4,6,8) having various heat exchange means disposed therein. The heat exchanger is formed of a first vertically elongated cylindrical pressure containment vessel (4) housing a radiant cooling chamber (12) therein, a second vertically elongated cylindrical pressure containment vessel (6) housing a convective cooling chamber (30) therein, and a pressure containment pipe (8) connecting the second pressure containment vessel (6) to the first pressure containment vessel (4) and housing therein a water-cooled duct (26) connecting the gas outlet of the radiant cooling chamber (12) disposed within the first pressure containment vessel (4) to the gas inlet of the convective cooling chamber (30) disposed within the second pressure containment vessel (6).

3 Claims, 5 Drawing Figures

STEAM GENERATING HEAT EXCHANGER

This is a continuation of application Ser. No. 114,472, filed Jan. 23, 1980 abandoned.

BACKGROUND OF THE INVENTION

The present invention relates to a method and an apparatus for cooling a high pressure, hot gas laden with ash particles, and more particularly to a heat exchanger design for recovering heat from the high pressure combustible product gas produced in a pressurized coal gasifier and utilizing said heat to produce superheated steam.

A number of coal gasification schemes have been developed in the past few years which produce a combustible product gas which can be upgraded to pipeline quality to supplement our nation's natural gas resources. The chemical reactions occurring in these gasification processes typically occur at temperatures ranging from 1350 to 1650 C. Further, pressures in the range of 1.7 to 10 megapascals are required in order to satisfy system requirements. Other gas cleaning and processing steps are required subsequent to the gasification reaction to produce a product gas suitable for pipeline transmission. Prior to these gas cleaning and processing steps, it is necessary to cool the product gas leaving the gasification chamber from a temperature as high as 1650 C. to a much lower gas handling temperature typically on the order of 200 to 350 C.

A major problem associated with cooling the product gas leaving the gasification chamber is the high concentration of molten ash in the product gas. The reduced gas volume associated with the high gas pressure results in extremely high ash loadings. Typical ash loadings encountered in pressurized gasifier heat exchange sections exceed 2500 kilograms ash per hour per square meter of flow area as compared to typical ash loadings of 50 to 250 kilograms ash per hour per square meter of flow area in conventional coal-fired power plant heat exchanger sections. Therefore, precautions must be taken to avoid plugging of the heat exchanger with accumulated ash deposits which would adversely affect the heat transfer and pressure drop through the heat exchange section.

SUMMARY OF THE INVENTION

The steam generating heat exchanger of the present invention comprises an inverted U-shaped pressure containment structure having various heat exchange means disposed therein, said pressure containment structure comprising a first pressure containment vessel, a second pressure containment vessel, and a pressure containment pipe connecting the second pressure containment vessel to the first pressure containment vessel.

The first pressure containment vessel comprises a vertically elongated cylinder having a gas inlet at the bottom thereof and a gas outlet at the top thereof. A radiant cooling chamber formed of a plurality of vertically extending steam generating heat exchange tubes is disposed within the first pressure containment vessel and establishes a gas pass extending therethrough. Hot gases from the reaction chamber flow vertically upward through the radiation chamber disposed within the first pressure containment vessel with a major portion of the molten ash particles entrained in the hot gases entering the radiation chamber depositing upon the walls of the radiation chamber. The hot gases are cooled to a temperature low enough to insure that any ash still entrained within the cool product gas leaving the radiation chamber is dry particulate ash.

The second pressure containment vessel comprises a vertically elongated cylinder having a gas inlet at the top thereof and a gas outlet at the bottom thereof. A convective cooling chamber formed of a plurality of vertically extending steam generating heat exchange tubes is disposed within the second pressure containment vessel and establishes a vertical gas pass extending therethrough. A plurality of heat exchange tube bundles are disposed within the vertical gas pass formed by the convective cooling chamber to heat and evaporate water.

The cooled gases leaving the radiant cooling chamber of the first pressure containment vessel are conveyed to the inlet of the convective cooling chamber through a conductor duct disposed within the pressure containment pipe joining the first and second pressure containment vessels. The gases are further cooled as they flow vertically downward over various heat exchange tube bundles disposed within the convective cooling chamber such that the gases leave the second pressure containment vessel at a temperature of 200 to 350 C.

DETAILED DESCRIPTION OF THE PREFERRED EMBODIMENT

Figure 1:
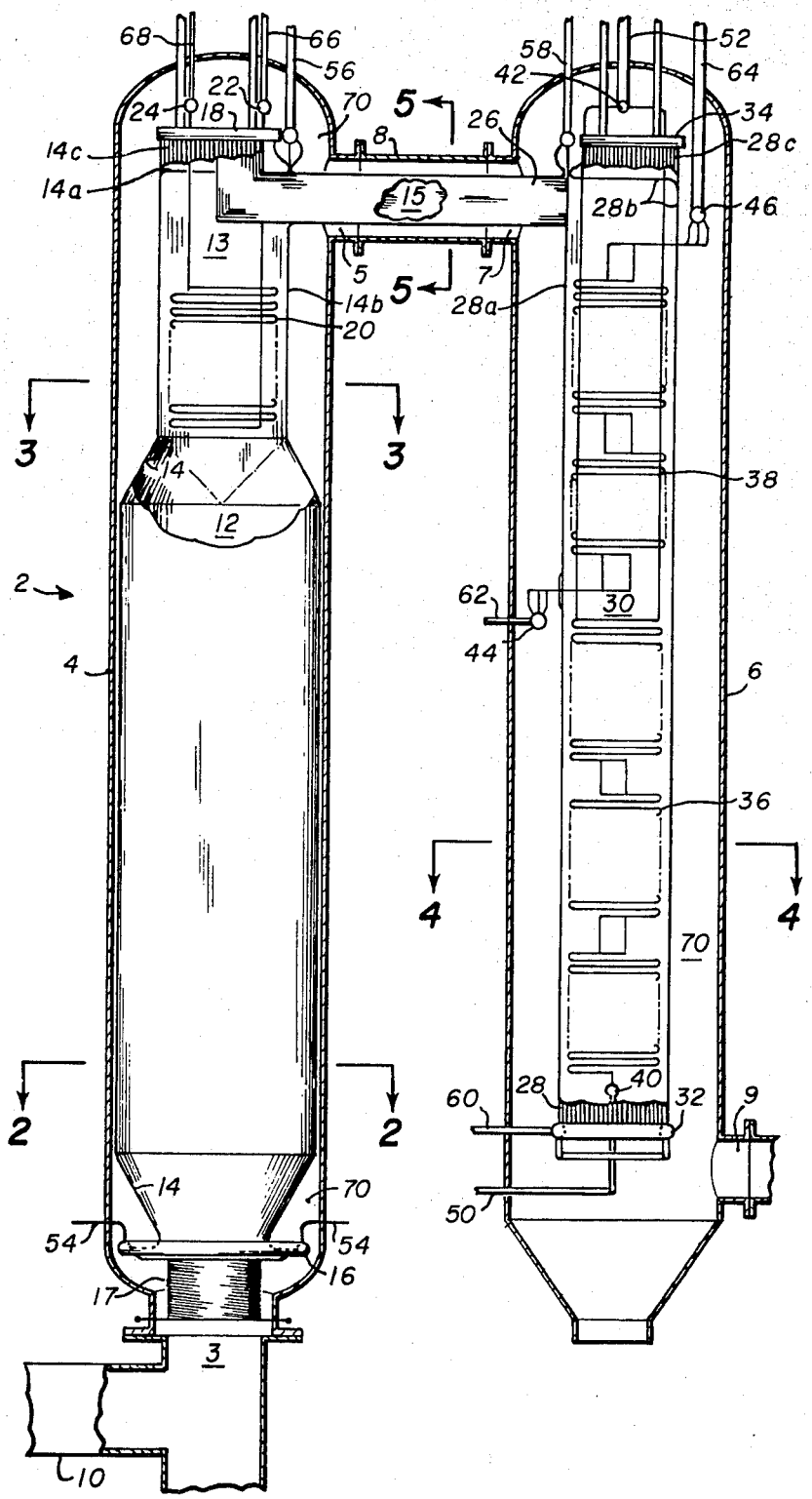
FIG. 1 is a sectional side elevational view of a steam generating heat exchanger designed in accordance with the present invention.

Referring now to the drawings and more particularly to FIG. 1 thereof, there is depicted a steam generating heat exchanger 2 designed in accordance with the present invention. The steam generating heat exchanger 2 comprises an inverted U-shaped pressure containment structure having various heat exchange means disposed therein. The pressure containment structure of the steam generating heat exchanger 2 comprises a first vertically elongated cylindrical pressure containment vessel 4 having a gas inlet 3 at the bottom thereof and a gas outlet 5 at the top thereof, a second vertically elongated cylindrical pressure containment vessel 6 having a gas inlet 7 at the top thereof and a gas outlet 9 at the bottom thereof, and a pressure containment pipe 8 connecting the gas inlet 7 of the second pressure containment vessel 6 to the gas outlet 5 of the first pressure containment vessel 4.

High pressure, hot product gas laden with molten ash passes from a reaction chamber wherein it is produced, such as a pressurized coal gasifier, to the steam generating heat exchanger 2 to be cooled therein prior to subsequent gas cleaning and processing operations conducted downstream of the heat exchanger. Such a gas would typically be passed to the steam generating heat exchanger 2 at a pressure of 15 to 105 kilograms per square centimeter and at a temperature of 1350 to 1650 C. The hot gas from the reaction chamber, not shown, passes into the steam generating heat exchanger 2 through refractory lined inlet tee 10. The hot gas from the reaction chamber enters inlet tee 10 horizontally and turns 90 degrees passing vertically upward out of the inlet tee 10 into gas inlet 3 of the first pressure containment vessel 4. It is estimated that 25 to 50 percent of the molten ash particles entrained in the hot gas entering inlet tee 4 will precipitate out of the gas stream as the gas stream turns upward to enter vessel 4. This ash will drop vertically downward out of the inlet tee for collection is slag/ash hopper (not shown) disposed directly beneath and secured to inlet tee 10.

Housed within the interior of the first pressure containment vessel 4 is a radiant cooling chamber 12 formed of a plurality of steam generating heat exchange tubes 14 arranged side-by-side to form a waterwall extending generally vertically upward from one or more radiant waterwall inlet headers 16 disposed in the lower portion of the first pressure containment vessel 4 at a location near the gas inlet 3 to one or more radiant waterwall outlet headers 18 disposed in the uppermost region of vessel 4, so as to establish a gas pass extending therethrough from the gas inlet 3 to the gas outlet 5 of the vessel 4. The hot product gas must traverse radiant cooling chamber 14 as it passes through the first pressure containment vessel 4. The gas inlet 3 is lined with helical heat exchange tube coils 17 through which cooling water is circulated to cool that portion of vessel 4 surrounding the gas inlet 3. Tube coils 17 also serve as a gas barrier to prevent the hot gas entering vessel 4 from contacting the radiant waterwall inlet headers 16. Alternatively, the gas inlet 3 may be lined with refractory brick rather than heat exchange coils.

Figure 3:
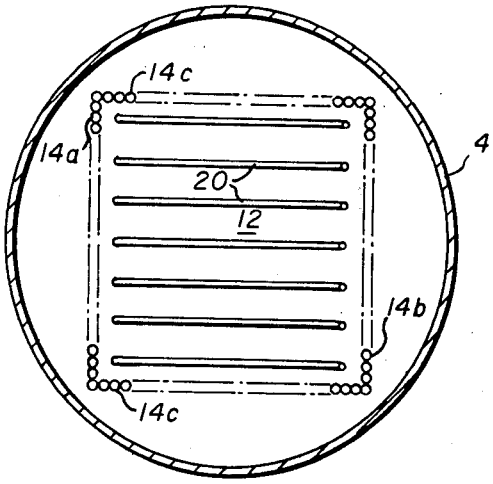
FIG. 3 is a sectional plan view taken along line 3—3 of FIG. 1.
Figure 2:
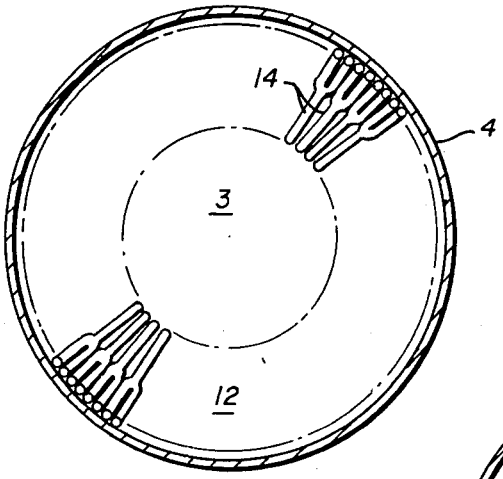
FIG. 2 is a sectional plan view taken along line 2—2 of FIG. 1.

In the preferred embodiment of the invention, as illustrated in FIGS. 2 and 3, the steam generating heat exchange tubes 14 turn upwardly and outwardly from the radiant waterwall inlet header 16 to the interior wall of the first pressure containment vessel 4, thence extend vertically upward lining the interior of the vessel 4, and thence bend inwardly and upwardly in the upper portion of vessel 4 before extending vertically upward again to the radiant waterwall outlet header 18 in the form of a rectilinear outlet duct 13 having sidewalls formed of heat exchange tubes 14C, a front wall formed of heat exchange tubes 14A, and a rear wall formed of heat exchange tubes 14B. Heat exchange tubes 14A which form the front wall of the outlet duct 13 bend to extend horizontally across the top of outlet duct 13 to form the roof thereof.

The hot product gas passing through radiation chamber 12 is cooled to a temperature sufficiently below the initial deformation temperature of the entrained ash particles to insure that only dry ash particles remain in the cooled product gas leaving chamber 12. Preferably, the temperature of the cooled gas flowing from radiant cooling chamber 12 into outlet duct 13 is approximately 980 C.

If superheated steam is desired, a superheater tube bundle 20 may be disposed in outlet duct 13 immediately above the radiant cooling chamber 12 as shown in the preferred embodiment illustrated in FIG. 1. Superheater tube bundle 20 typically comprises a plurality of horizontal tube rows disposed in vertical planes parallel to the sidewalls of outlet duct 13 and spaced across the width thereof at sufficiently wide intervals to insure that the free area between neighboring tube rows is not bridged by deposits of ash particles precipitating from the cooled product gas leaving the radiant cooling chamber 12. Each of the tubes forming the superheater tube bundle 20 is connected at its inlet end to superheater inlet header 22 and at its outlet end to superheater outlet header 24, both headers being located out of the gas stream in the void space between the inner surface of vessel 4 and the waterwall defined by heat exchange tubes 14. If required, soot blowers may be incorporated into radiation chamber 12 and outlet duct 13 to provide a means for cleaning ash deposits from the walls thereof and from the superheater surface disposed therein.

The cooled gas leaving the radiant cooling chamber 12 passes through outlet duct 13 into gas pass 15 of connector duct 26. Connector duct 26 is formed of a plurality of heat exchange tubes disposed side-by-side to form a gas pass extending from an opening in the sidewall of outlet duct 13 through the gas oullet 5 of the first pressure containment vessel 4, thence through the pressure containment pipe 8, and thence through the gas inlet 7 of the second pressure containment vessel 6.

Housed within the second pressure containment vessel 6 is a convective cooling chamber 30 formed of a plurality of vertically extending steam generating heat exchanger tubes 28 disposed side-by-side within the vessel 6 so as to establish a gas pass extending therethrough from the gas inlet 7 to the gas outlet 9 thereof. An opening is provided in the upper portion of the convective cooling chamber to mate with connecting duct 26 so as to receive the cooled product gas leaving the first vessel 4 through gas pass 15.

The heat exchange tubes 28 forming the convective cooling chamber 30 extend vertically from one or more convective cooling chamber waterwall inlet headers 32 disposed in the bottom portion of vessel 6 at an elevation near the gas outlet 9 of vessel 6 upward to one or more convective cooling chamber waterwall outlet headers 34 disposed in the uppermost portion of vessel 6. At least one convective heat exchanger, such as an economizer or evaporator, is disposed within the convective cooling chamber 30 such that the ash and gas passing therethrough must traverse the heat exchanger thereby providing for the further cooling of the product gas.

Figure 4:
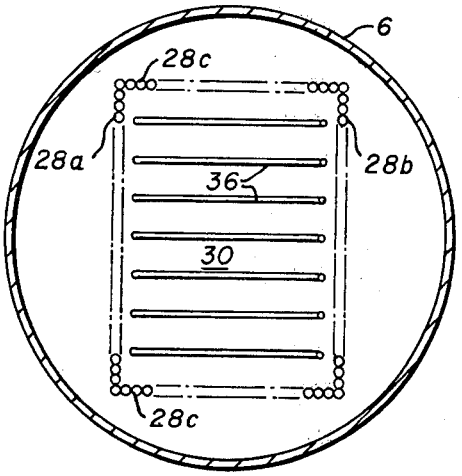
FIG. 4 is a sectional plan view taken along line 4—4 of FIG. 1.

In the preferred embodiment of the present invention, the convective cooling chamber 30 is of rectilinear cross section, as shown in FIG. 4, having a front wall formed of heat exchange tubes 28A, a rearwall formed of heat exchange tubes 28B, and sidewalls formed of heat exchange tubes 28C. Heat exchange tubes 28B which form the rearwall of convective cooling chamber 30 are bent to extend horizontally across the top of the convective cooling chamber to form the roof thereof.

As illustrated in FIG. 1, disposed within the convective cooling chamber 30 are heat exchangers 36 and 38 comprising an economizer and an evaporator, respectively. Economizer 36, preferably disposed in the lower portion of the convective cooling chamber 30, comprises a plurality of vertically arrayed tube banks of horizontal tube rows connected between an economizer inlet header 40 disposed beneath economizer 36 and an economizer outlet header 42 disposed in the upper portion of vessel 6. Evaporator 38, preferably disposed in the upper portion of the convective cooling chamber 30, comprises a plurality of vertically arrayed tube banks of horizontal tube rows connected between an evaporator inlet header 44 and an evaporator outlet header 46.

Figure 5:
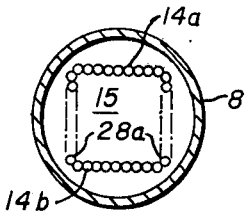
FIG. 5 is a cross-sectional view taken along line 5—5 of FIG. 1.

In the preferred embodiment of the present invention, the connector duct 26, which provides a gas pass for conveying the gases from the outlet duct 13 of the radiant cooling chamber 12 of the first pressure containment vessel 4 to the convective cooling chamber 30 of the second pressure containment vessel 6, is formed of heat exchange tubes 14 and 28 as shown in FIG. 5. More specifically, a portion of the heat exchange tubes 14A which form the front wall and roof of the outlet duct 13 of radiant cooling chamber 12 extend through containment pipe 8 to the convective cooling chamber waterwall outlet header 34 thereby forming the roof of the connector duct 26. Additionally, a portion of the heat exchange tubes 14B which form the rearwall of the outlet duct 13 of the radiant cooling chamber 12 are turned to extend horizontally through containment pipe 8 to the convective cooling chamber 30 thereby forming the floor of connector duct 26. The sidewalls of connector duct 26 are similarly formed by bending a portion of the heat exchange tubes 28A which form the front wall of the convective cooling chamber 30 to extend horizontally out of the gas inlet 7 of the second pressure containment vessel 6 and through containment pipe 8 into the outlet duct 13 within the first pressure containment vessel 4.

The cooled reaction gases leaving the outlet duct 13 of the radiant cooling chamber 12 are further cooled to a temperature preferably in the range of 200 to 350 C. as they pass through the water-cooled connector duct 26 and flow vertically downward through the convective cooling chamber 30 traversing heat exchanger 36 and 38 disposed therein. As the vertically downward flowing product gases leave the convective cooling chamber 30, they turn within the bottom of the second pressure containment vessel 6 through a U-shaped path to leave vessel 6 horizontally through the gas outlet 9 thereof. As the gases turn at the bottom of vessel 6, much of the dry ash particles still entrained therein precipitate out and collect in an ash hopper, not shown, disposed therebeneath. If required, soot blowers may be incorporated into chamber 30 to provide a means for cleaning ash deposits from the walls thereof and from the heat exchanger tube bundles disposed therein.

It should be noted at this point, that the walls forming the radiant cooling chamber 12, the connector duct gas pass 15, and the convective cooling chamber 30 need not be designed to withstand the high pressure of the product gas. A portion of the cool product gases leaving the convective cooling chamber 30 turn in the bottom of vessel 6 and enter the void space 70 through the open gap between the outer surface of chamber 30 and the inner surface of vessel 6. These cooled gases eventually fill the entirety of void space 70, thereby eliminating any pressure differential across the walls forming the radiant cooling chamber 12, the connector duct gas pass 15, or the convective cooling chamber 30. If desired, a purge system, using a noncorrosive gas such as nitrogen or carbon dioxide, is provided for purging the void space 70 of any product gases when the heat exchanger is taken out of service.

In the steam generator of the present invention, feedwater is supplied to the economizer inlet header 40 through feedwater supply lines 50 and heated as it circulates through economizer 36 in heat exchange relationship with the product gases flowing through the convective cooling chamber 30. The heated water leaving the economizer 30 is collected in economizer outlet header 42 and fed therefrom to a water and steam drum (not shown) located outside of and above the pressure containment structure of heat exchanger 2 through economizer link 52 which penetrates the wall of vessel 6.

Saturated or slightly subcooled water flows from the water and steam drum through downcomers (not shown) for distribution to the steam generating circuit of heat exchanger 2. A portion of the downcomer water is supplied to the radiant waterwall inlet header 16 through feedline 54. The water then flows upwardly through steam generating heat exchange tubes 14 forming the radiant cooling chamber 12 and the outlet duct 13 thereto. A water and steam mixture is generated within tubes 14 as water vaporizes upon absorbing heat radiated by the hot product gases passing through the radiant cooling chamber 12. The steam and water mixture leaving tubes 14 is collected in the radiant waterwall outlet header 18 and returned to the steam and water drum through riser pipe 56 which penetrates the wall of vessel 4. Similarly, the steam and water mixture flowing through that portion of heat exchange tubes 14A which form the roof of the outlet duct 13 and the connector duct 26, and the steam and water mixture flowing through that portion of heat exchange tubes 14B which form the flow of connector duct 26 are collected in the convective cooling chamber waterwall outlet header 34 and passed to the steam and water drum through riser pipe 58 which penetrates the wall of vessel 6.

Simultaneously with the circulation of water through tubes 14 of the radiant cooling chamber 12, another portion of the downcomer water is supplied to the convective cooling chamber waterwall inlet header 32 through feedlines 60. The water then flows upwardly through steam generating tubes 28 forming the convective cooling chamber 30. A steam and water mixture is generated within tubes 28 as the water absorbs heat from the product gases flowing through the convective cooling chamber 30. The steam and water mixture leaving tubes 28 is collected in the convective cooling chamber waterwall outlet header 34 and returned to the steam and water drum through riser pipe 58. The steam and water mixture flowing through that portion of heat exchange tubes 28 which forms the sidewall of the connector duct 26 is collected in the radiant waterwall outlet header 18 and returned to the steam and water drum through riser pipe 56.

A third portion of downcomer water is simultaneously supplied to the evaporator inlet header 44 through feedline 62. The water then flows through evaporator 38 in heat exchange relationship with the product gases flowing therethrough the convective cooling chamber 30. In so doing, a steam and water mixture is generated within evaporator 38 as a portion of the water vaporizes upon absorbing heat from the product gas. The steam and water mixture is collected in evaporator outlet header 46 and returned to the steam and water drum through riser pipe 64 which penetrates the wall of vessel 6.

Saturated steam from the water and steam drum is passed to suerheater inlet header 22 via line 66. The steam is then superheated to a predetermined desired temperature as it flows through superheater 20 in heat exchange relationship with the product gases leaving the radiant cooling chamber 12 via outlet duct 13. The superheated steam is collected in superheater outlet header 24 and passed from the steam generating heat exchanger 2 through steam line 68 which penetrates the wall of vessel 4. The superheated steam may be used in a number of processes related to the gasification of coal but is particularly useful in the production of hydrogen gas from the coal through well-known reactions.

I claim:

1. A steam generating heat exchanger for cooling a high pressure, hot gas, comprising:

a. a first vertically elongated cylindrical pressure containment vessel having a gas inlet at one end thereof and a gas outlet at the opposite end thereof;

b. a second vertically elongated cylindrical pressure containment vessel having a gas inlet at one end thereof and a gas outlet at the opposite end thereof;

c. a pressure containment pipe connecting the gas inlet of said second pressure containment vessel to the gas outlet of said first pressure containment vessel;

d. a first inlet header disposed within said first pressure containment vessel at the bottom thereof;

e. a first outlet header disposed within said first pressure containment vessel at the top thereof;

f. a second inlet header disposed within said second pressure containment vessel at the top thereof;

g. a second outlet header disposed within said second pressure containment vessel at the bottom thereof;

h. a radiant cooling chamber disposed within said first pressure containment vessel so as to establish a gas pass extending therethrough from the gas inlet to the gas outlet thereof, said radiant cooling chamber formed of a plurality of steam generating heat exchange tubes arranged side-by-side with a first portion of the tubes extending vertically from said first inlet header to said first outlet header thereby establishing a first fluid circuit and with a second portion of the tubes extending vertically from said first inlet header to said second outlet header thereby establishing a second fluid circuit;

i. a convective cooling chamber disposed within said second pressure containment vessel so as to establish a gas pass extending therethrough from the gas inlet to the gas outlet thereof, said convective cooling chamber formed of a plurality of steam generating heat exchange tubes arranged side-by-side with a first portion of the tubes extending vertically from said second inlet header to said second outlet header thereby establishing a third fluid circuit to said second outlet header and with a second portion of the tubes extending vertically from said second inlet header to said first outlet header thereby establishing a fourth fluid circuit;

j. a cooled connector duct disposed within said pressure containment pipe so as to establish a gas pass extending therethrough from the radiant cooling chamber disposed within said first pressure containment vessel to the convective cooling chamber disposed within said second pressure containment vessel, said connector duct formed in part by the second portion of the steam generating heat exchange tubes forming the radiant cooling chamber and in part by the second portion of the steam generating heat exchange tubes forming the convective cooling chamber;

k. at least one convective heat exchanger disposed in the gas pass within the convective cooling chamber of said second pressure containment vessel;

l. means for supplying cooling water to said first inlet header;

m. means for supplying cooling water to said second inlet header;

n. means for removing hot water and steam from said first outlet header; and o. means for removing hot water and steam from said second outlet header.

2. A steam generating heat exchanger as recited in claim 1 wherein a steam generating heat exchange tube bundle is disposed in the upper portion of the convective cooling chamber of said second pressure containment vessel and an economizer heat exchange tube bundle is diposed in the lower portion of the convective cooling chamber of said second pressure containment vessel.

3. A steam generating heat exchanger as recited in claim 1 wherein a steam superheater tube bundle is disposed in the outlet duct of the radiant cooling chamber of said first pressure containment vessel.

* * * * *

UNITED STATES PATENT AND TRADEMARK OFFICE

CERTIFICATE OF CORRECTION

PATENT NO. : 4,398,504

DATED : August 16, 1983

INVENTOR(S) : Andrew F. Kwasnik, Jr.

It is certified that error appears in the above—identified patent and that said Letters Patent is hereby corrected as shown below:

Column 6, line 61, change "suerheater" to --superheater-- .

Column 8, line 36, change "diposed" to --disposed-- .

Column 8, line 40, change "claim 1" to --claim 2-- .

Signed and Sealed this

*Fifteenth* Day of *May 1984*

[SEAL]

*Attest:*

*Attesting Officer*

GERALD J. MOSSINGHOFF

*Commissioner of Patents and Trademarks*